US007578336B2

(12) United States Patent
Stahl, Jr. et al.

(10) Patent No.: US 7,578,336 B2
(45) Date of Patent: Aug. 25, 2009

(54) CASTING MOLD AND METHOD FOR CASTING ACHIEVING IN-MOLD MODIFICATION OF A CASTING METAL

(75) Inventors: Kenneth George Stahl, Jr., St. Charles, MI (US); Venkatramanan Srinivasan, St. Charles, MI (US); James T. Singer, Ney, OH (US); Edward C. Wall, Midland, MI (US); Mark A. Osborne, Midland, MI (US)

(73) Assignee: GM Global Technology Operations, Inc.

( * ) Notice: Subject to any disclaimer, the term of this patent is extended or adjusted under 35 U.S.C. 154(b) by 0 days.

(21) Appl. No.: 11/818,258

(22) Filed: Jun. 13, 2007

(65) Prior Publication Data

US 2007/0246185 A1 Oct. 25, 2007

Related U.S. Application Data

(63) Continuation of application No. 10/790,613, filed on Mar. 1, 2004, now abandoned.

(51) Int. Cl.
*B22D 27/00* (2006.01)
*B22D 27/20* (2006.01)

(52) U.S. Cl. ..... 164/57.1; 164/134

(58) Field of Classification Search ..... 164/57.1, 164/58.1, 270.1, 63, 255, 349, 134, 358
See application file for complete search history.

(56) References Cited

U.S. PATENT DOCUMENTS

| | | | | |
|---|---|---|---|---|
| 4,749,549 | A | 6/1988 | Hornung et al. | |
| 4,867,227 | A * | 9/1989 | Trager et al. | 164/59.1 |
| 5,033,531 | A * | 7/1991 | Fisher et al. | 164/57.1 |
| 5,161,604 | A * | 11/1992 | Chandley et al. | 164/57.1 |
| 5,230,754 | A * | 7/1993 | Setzer et al. | 148/437 |
| 5,259,442 | A | 11/1993 | Clark | |
| 6,540,005 | B1 * | 4/2003 | Daussan et al. | 164/58.1 |
| 6,793,707 | B2 * | 9/2004 | Craig et al. | 75/305 |
| 7,011,133 | B2 * | 3/2006 | Eckert | 164/5 |

* cited by examiner

*Primary Examiner*—Kevin P Kerns
(74) *Attorney, Agent, or Firm*—Harness, Dickey & Pierce, P.L.C.

(57) ABSTRACT

A casting mold and method for its use to achieve in-mold modification of the casting metal is disclosed. One or more chambers are located within the casting mold's runner system. Each chamber can contain metallurgical modifiers for adjusting the chemical composition of the metal to improve the mechanical and physical properties of an article cast from the metal. One or more modifiers can be placed in the chamber(s) as the casting mold is assembled for use. As the melt is introduced to the casting mold, it passes through the chamber (s) and liquefies the modifier. Amounts of the liquid modifier, then, are carried away and become dispersed in the melt as it continues through the runner system and into the mold cavity. The metallurgical modifiers can be selected from any number of known additives or alloying elements, including strontium, among others.

20 Claims, 2 Drawing Sheets

CASTING MOLD AND METHOD FOR CASTING ACHIEVING IN-MOLD MODIFICATION OF A CASTING METAL

CROSS-REFERENCE TO RELATED APPLICATIONS

This application is a continuation of U.S. patent application Ser. No. 10/790,613 filed on Mar. 1, 2004, which is now abandoned. The disclosure of the above application is incorporated herein by reference.

FIELD OF THE INVENTION

The present invention relates to a casting mold and casting method for achieving in-mold modification of a casting metal, such as an aluminum alloy, by the addition of one or more metallurgical additives for improving the mechanical and physical properties of the cast article.

BACKGROUND OF THE INVENTION

Cast metal articles are made at a foundry by introducing molten metal into a mold from a relatively large volume of molten metal (i.e., a melt). It is well known to adjust the chemical composition of a casting metal to improve the mechanical and physical properties of an article cast from the metal. This is accomplished by the addition of one or more metallurgical additives or modifiers.

Some additives or modifiers "modify" the way a cast material solidifies. The desired effects of the modifying material can be observed at the microscopic or metallographic level. The size, shape and crystalline composition of the microconstituents of the solidified alloy can be influenced through the addition of small amounts of "modifiers." These modifiers typically exhibit little or no "alloying" effect, in the sense that they have negligible impact on the chemical composition of the melt. In this regard, the melt is modified by liquefying and dispersing the modifiers in the melt, before it is used to fill a mold.

Molten aluminum can be alloyed by the addition of alloying elements. Common aluminum alloying elements include copper, iron, magnesium, manganese, nickel, silicon, tin, and zinc. These alloying elements are typically added to the molten melt to formulate a specific aluminum casting alloy. Modifying elements, alloys and compounds may also be dispersed in the aluminum melt. Such additives include antimony, beryllium, boron, calcium, phosphorus, silver, sodium, strontium, titanium, titanium boron, vanadium, zirconium, and other elements and compounds of elements.

Strontium, in particular, is known to have a notable impact on the silicon morphology, porosity distribution and porosity volume in a casting, positively influencing the mechanical properties and the functional aspects (e.g., leak prevention) of the cast article.

Metallurgical modifiers, including strontium, are conventionally added to an aluminum melt in relatively small bricks, pellets or tablets that are subsequently liquefied and dispersed in the melt. It is also known to include these additives by moving an alloy wire into a stream of the molten metal. The introduction of the additives to the melt is typically performed at the holding furnace, launder, or ladle and at a predetermined time prior to pouring the melt into the mold.

Control over the time that elapses between the introduction of the modifier to the melt and use of the melt is important because the desired and beneficial effects of metallurgical modifiers that are dissolved in a melt diminish with the passage of time. This phenomenon is known as fade. Such degradation of the efficacy of the metallurgical modifier is an undesired result and reduces the effective concentration of the metallurgical modifier in the aluminum melt. Consequently, to counter the negative impact of fade, it is often the practice to over-treat the molten melt with strontium or other modifiers. When dealing with the metallurgical modifier strontium, in particular, it is believed in the foundry industry that the modifying alloy of strontium must be added to the melt before the metal is introduced to the mold so that the strontium can disperse throughout the melt.

Foundry practices that improve both the manner in which metallurgical modifiers are introduced into the melt and their resultant effectiveness in enhancing the mechanical and physical properties of the cast article, therefore, continue to be sought.

SUMMARY OF THE INVENTION

Accordingly, the invention provides a casting mold, such as is known in sand casting processes, and a method for its use for achieving the in-mold modification of the casting metal. In addition to one or more mold components, such as a mold segment or a mold core, the casting mold generally includes the features of a sprue (also referred to as a mold inlet), through which the molten metal flows into the casting mold; a runner system having one or more channels that carry the molten metal from the sprue to the mold cavity; and one or more gates, that provide the inlets into the mold cavity from the runner system.

Included in the casting mold of the invention, however, is at least one chamber that is located within the casting mold's runner system. The chamber is designed to contain metallurgical additives or alloying elements for the purpose of adjusting the chemical composition of the casting metal and improving the mechanical and physical properties of an article that is cast from the metal.

The modifiers can generally be provided as rod or bar stock or in a granular or pellet form. One or more such solid modifiers may be placed within the chamber as the casting mold is assembled for use. Upon introduction of the molten melt to the casting mold, the melt liquefies the modifier as it passes through the chamber. Amounts of the liquid modifier, then, are carried away, and become dispersed in the melt as it continues through the runner system and into the mold cavity.

The metallurgical additives can be selected from any number of known materials specifically including, though not limited to, antimony, beryllium, boron, calcium, fluxing salts, phosphorus, silver, sodium, strontium, titanium, titanium boron, vanadium, and zirconium, individually or in combination.

In particular, the invention has the demonstrated capability for the addition of strontium within the casting mold to an aluminum-silicon casting melt. This is contrary to conventional wisdom in the foundry art and the typical practice of adding strontium to the entire metal melt at the holding furnace.

The invention is flexible and it may accommodate any of a variety of casting molds and applications including, for example, single cavity or multi-cavity casting molds.

The number of chambers and their physical configuration and location in a given casting mold may vary as desired or necessary, such as to accommodate either a particular mold design or the requirements of an article to be cast. For example, the casting mold may include one or more chambers at one or more specific locations within the runner system in order to provide localized modification of the melt at specific areas in a cast article. Also, the invention contemplates that one or more chambers may be employed in a casting mold and each contain one or more modifiers for adjusting the chemistry of the melt. As such, the invention provides for the controlled distribution of metallurgical modifiers throughout a cast article.

The invention thus provides improved consistency and better control over the mechanical and physical properties of articles cast in the mold, casting-to-casting and mold-to-mold. The invention simplifies the process of adding metallurgical modifiers, and reduces labor and material costs that are associated with the continuous monitoring and modification of an entire molten melt with modifiers. The invention also minimizes the impact of fade on the modified melt.

Other benefits of the invention include reducing or eliminating the formation of sludge at the bottom of the holding furnaces caused by the modifiers. Such sludge negatively impacts the casting process both clogging the electromagnetic metal pumps sometimes used to deliver the molten metal to the casting molds and resulting in inclusions in the castings.

Further areas of applicability of the present invention will become apparent from the detailed description provided hereinafter. It should be understood that the detailed description and specific examples. While indicating the preferred embodiment of the invention, are intended for purposes of illustration only and are not intended to limit the scope of the invention.

BRIEF DESCRIPTION OF THE DRAWINGS

The invention will become more fully understood from the detailed description and the accompanying drawings. The components in the drawings are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

The following description of the preferred embodiment(s) is merely exemplary in nature and is in no way intended to limit the invention, its application, or uses.

Figure 1:
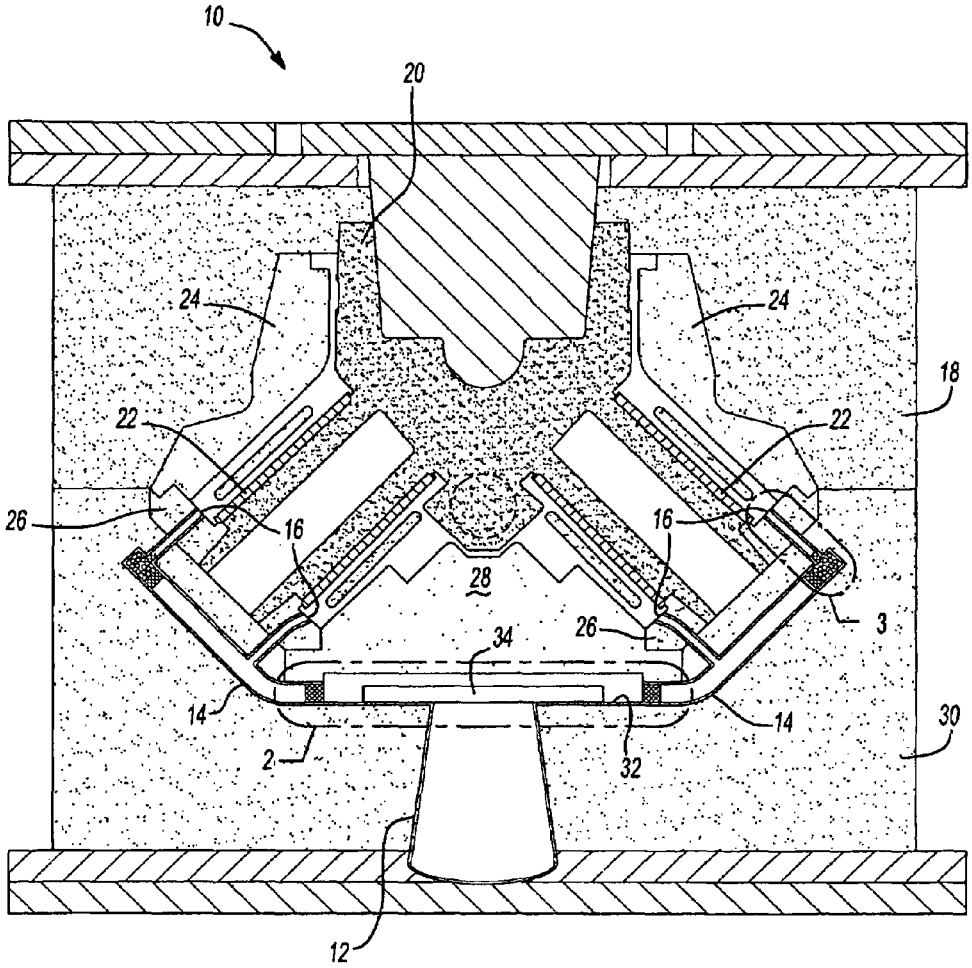
FIG. 1 is a simplified cross-sectional view of a casting mold package for an engine block (without the end core) incorporating the invention.

A precision sand casting process for casting articles from molten metal generally employs an expendable casting mold (also referred to as a mold package), such as one shown in the simplified cross-section of FIG. 1 at 10, for example. The mold package 10 is assembled from various mold elements or components, typically made from resin-bonded sand. The mold components are combined to form a cavity that defines the internal and external surfaces of the article to be cast.

Also included in conventional casting molds are other major mold features including a sprue 12 (also referred to as a mold inlet) through which the molten metal is introduced into the mold, a runner system 14 comprising one or more channels that carry the molten metal from the sprue 12 to the mold cavity, one or more gates 16 that provide the inlets into the mold cavity from the runner system 14, risers (not shown) that supply additional metal to the casting to account for shrinkage during the solidification of the molten metal in the mold 10, and vents (not shown) to allow gases and air to escape from the mold 10 as the molten metal enters.

For purposes of illustration and not limitation, the resin-bonded sand cores that are shown in FIG. 1 are for use in assembly of an engine cylinder block mold package to cast a V-type aluminum engine block. The invention is especially useful, although not limited to, assembling casting molds for precision sand casting of V-type engine cylinder blocks, although other configurations and parts may be cast with casting molds according to the invention.

The mold package 10 is assembled from several resin-bonded sand cores including a base core 18, an integral barrel crankcase core (IBCC) 20 having metal (e.g. cast iron, aluminum, or aluminum alloy) cylinder bore liners 22, two end cores (not shown), two side cores 24, two slab core assemblies 26, a valley core 28, and a cover core 30. The cores described above are offered for purposes of illustration and not limitation as other types of cores and core configurations may be used in the casting mold of the invention, depending upon the particular article to be cast.

The resin-bonded sand cores can be made using conventional core-making processes such as a phenolic urethane cold box or Furan hot box where a mixture of foundry sand and resin binder is blown into a core box and the binder cured with either a catalyst gas and/or heat. The foundry sand can comprise silica, zircon, fused silica, and others. A catalyzed binder can comprise Isocure binder available from Ashland Chemical Company.

Included in the casting mold 10 is at least one chamber 32 that is located within the runner system 14. The chamber 32 is designed to contain a metallurgical additive or alloying element 34 that is intended to influence and beneficially adjust the chemical composition of the casting metal to improve the mechanical and physical properties of the cast article.

The metallurgical additives or alloying elements 34 can be selected from any number of known materials specifically including, though not limited to, antimony, beryllium, boron, calcium, fluxing salts, phosphorus, silver, sodium, strontium, titanium, titanium boron, vanadium, zirconium, chrome, copper, iron, magnesium, manganese, nickel, silicon, tin, and zinc, or a combination of these materials. In particular, the invention has proved useful for the in-mold addition of strontium to a melt of a 319 aluminum silicon alloy.

FIG. 1 shows at least portions of the runner system 14 and gates 16 of the casting mold 10. As shown in FIG. 1, the runner system 14 includes several chambers that contain a metallurgical modifier. A first chamber 32 is shown near the sprue or mold inlet 12. Additional chamber(s) may also be included, such as further downstream in the runner system 14 near a gate 16 (see FIG. 3, chamber 36).

Of course, the number of chambers and their physical configuration and location in a given casting mold may vary as desired or necessary, such as to accommodate either a particular mold design or the particular metallurgical requirements of an article that is to be cast. For example, the casting mold may include one or more chambers at one or more specific locations within the runner system in order to provide localized modification of the melt at specific areas in a cast article. Also, the invention contemplates that one or more chambers may be employed in a casting mold and contain one or more modifiers for adjusting the chemistry of the melt. As such, the invention provides for the controlled distribution of metallurgical modifiers throughout a cast article.

In this regard, the invention is flexible and it may accommodate any of a variety of casting molds and applications including, for example, single cavity or multi-cavity casting molds.

Figure 2:
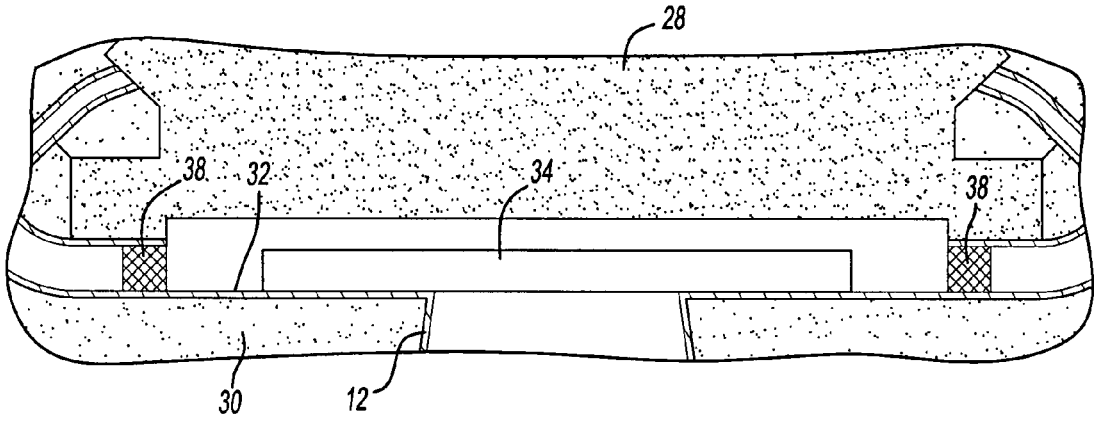
FIG. 2 is an enlarged view of detail 2 of FIG. 1.

Referring to FIG. 2, an enlarged detail view of chamber 32 is shown. As shown, the boundary of the chamber is defined as two different mold cores, the cover core 30 and the valley core 28, come together as the mold package 10 is assembled. Of course, the chamber 32 may be located entirely within a single mold core, or it may be created by the assembly of more than two mold cores, as desired or necessary to accommodate the casting mold design incorporating the invention.

Within the chamber 32 is a metallurgical modifier 34. The metallurgical modifier 34 comprises a solid metal, for example, rod or bar stock. Additionally the modifier 34 may take the form of pellets or granules. An exemplary modifier 34 that has proven useful in modifying an aluminum-silicon melt cast in a mold of the invention is a 5% strontium-containing alloy in the form of stock material, though it is contemplated that about a 3% to about a 15% strontium-containing alloy may be used. Examples of stock sizes that may be used include a ⅜ inch diameter Ti B Sr 6 rod, a 1 inch square "Castcut" bar, or a ⅞ inch diameter "Quicksol" bar, or a ⅜ in diameter rod.

When the mold components are assembled into the casting mold, the modifier 34 is placed in the chamber and becomes part of the casting mold package 10.

Positioned in the runner system 14 downstream of the modifier 34 and adjacent to the exit from the chamber 32 is a silicon carbide coated foam filter 38 which may be ceramic. As shown in FIG. 2, two such filters 38 are included because there are two exits downstream of the chamber 32. Consequently, the melt passes through the filter 38 as it continues through the mold 10. These filters 38 are commercially available, for example from SELEE® corporation or Foseco International Ltd. In addition to filtering particulates from the melt, the filters 38 aid in controlling the flow of the melt through the chamber 32 to ensure that the melt fills the chamber 32 and flows over and around the modifier 34. This is particularly important for the initial portion of the melt when it is first introduced to the casting mold 10.

After the mold package 10 is assembled, the molten metal, e.g. an aluminum alloy at a temperature above 1250° F., is introduced into the mold through the sprue 12. The aluminum melt flows from the sprue 12 into the runner system 14 and the chamber 32. As the melt fills the chamber 32, it flows over and around the modifier 34. As it does so, the modifier 34 slowly dissolves in the melt. The melt then passes through the filters 38 at the downstream ends of the chamber and eventually into the mold cavity. Because the modifier 34 dissolves in the melt over time, the modifier 34 is introduced to the entirety of the melt that passes through the chamber 32, improving the properties of the cast metal as it does so.

Figure 3:
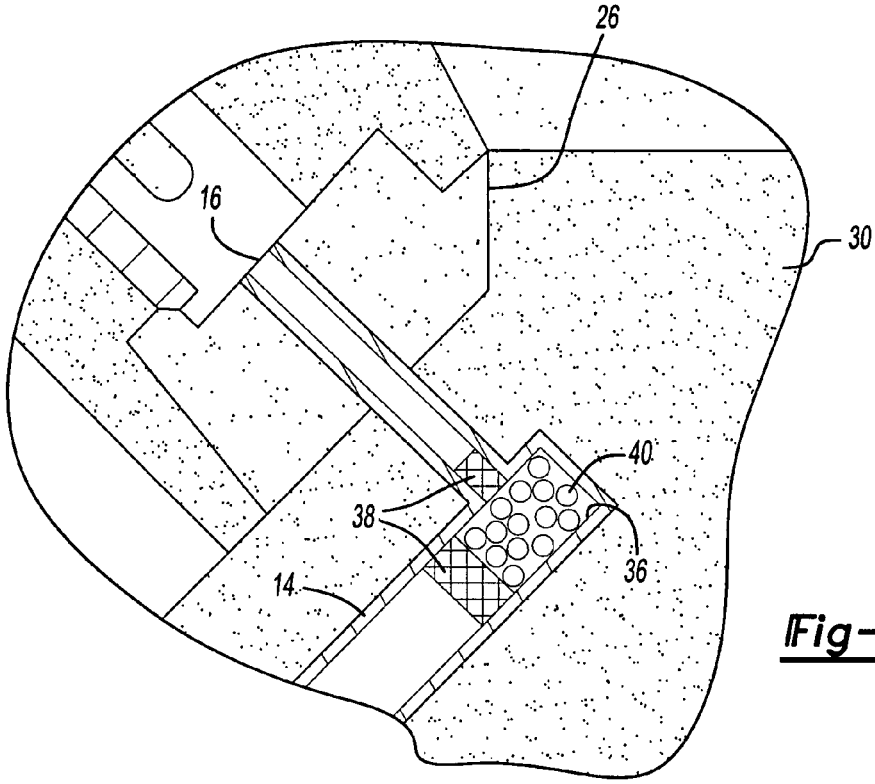
FIG. 3 is an enlarged view of detail 3 of FIG. 1.

As shown in FIG. 3, a chamber 36 is located near a gate 16 of the casting mold 10. Filters 38 retain a metallurgical modifier 40 that is in granular or pellet form. As previously described, when the melt reaches the chamber 36, it dissolves the modifier 40 and affects the chemistry of the melt. In this example, the effects of the modifier 40 are localized to the portion of the mold cavity that is fed by the gate 16 nearest the chamber 36.

It can be readily appreciated that the number of chambers included in the casting mold, their respective sizes, shapes and locations in the runner system (e.g., at or near one or more of the mold gates or at or near the mold inlet), as well as the types and amounts of metallurgical modifiers that are incorporated in the casting mold, may modified as necessary to accommodate the design of any particular casting mold or the particular metallurgical requirements for the article being cast.

This description of the invention is merely exemplary in nature and, while various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. A method for casting an article comprising:

providing a casting mold comprising:

a sprue;

a runner system comprising at least one channel;

at least one gate;

at least one mold element; and a plurality of chambers located within the runner system;

disposing a filter adjacent to the each of the plurality of chambers;

disposing a metallurgical modifier within each of the plurality of chambers adjacent the filter for each of the plurality of chambers;

introducing a silicon-containing molten aluminum alloy into the casting mold over the metallurgical modifier within at least one chamber;

modulating flow of the silicon-containing molten aluminum alloy through the at least one chamber with the metallurgical modifier and the filter; and forming a silicon-aluminum metal melt cast.

2. The method for casting an article of claim 1 wherein the metallurgical modifier is selected from the group consisting of, antimony, beryllium, boron, calcium, fluxing salts, phosphorus, silver, sodium, strontium, titanium, titanium boron, vanadium and zirconium, or a combination thereof.

3. The method for casting an article of claim 1 wherein the metallurgical modifier comprises about a 3% to about a 15% strontium-containing alloy in the form of stock material.

4. The method for casting an article of claim 1 wherein the metallurgical modifier is in the form of bar stock or rod stock material.

5. The method for casting an article of claim 1 wherein the metallurgical modifier is in granular form.

6. The method for casting an article of claim 1 wherein the metallurgical modifier is in pellet form.

7. The method for casting an article of claim 1 further wherein the casting mold comprises a plurality of mold cores and wherein the at least one chamber is bounded by at least two mold cores.

8. The method for casting an article of claim 1 further comprising:

locating the at least one chamber near the at least one gate.

9. The method for casting an article of claim 1 further comprising:

locating the at least one chamber near the sprue.

10. The method for casting an article of claim 1 wherein the filters comprise a silicon carbide coated ceramic.

11. The method for casting an article of claim 1 further comprising:

disposing more than a single type of metallurgical modifier in each of the plurality of chambers.

12. The method for casting an article of claim 1 wherein each of the plurality of chambers contains a different metallurgical modifier.

13. The method for casting an article of claim 1 further comprising:

adjusting the chemistry of silicon-containing molten aluminum alloy after the silicon-containing molten aluminum alloy is introduced into the casting mold.

14. A method for casting an article comprising:

providing a casting mold comprising:

a sprue;

a runner system comprising at least one channel;

at least one gate;

at least one mold element; and at least one chamber located within the runner system;

disposing at least two filters adjacent to the at least one chamber;

disposing a metallurgical modifier comprising strontium within the at least one chamber and between the at least two filters;

introducing a silicon-containing molten aluminum alloy into the casting mold over the metallurgical modifier within the at least one chamber;

modulating flow of the silicon-containing molten aluminum alloy through the chamber with the metallurgical modifier and the at least two filters; and forming a silicon-aluminum metal melt cast.

15. The method for casting an article of claim 14, further comprising:

disposing an additional metallurgical modifier in the at least one chamber, wherein the additional metallurgical modifier is selected from the group consisting of, antimony, beryllium, boron, calcium, fluxing salts, phosphorus, silver, sodium, titanium, titanium boron, vanadium and zirconium, or a combination thereof.

16. The method for casting an article of claim 14 further comprising:

adjusting the chemistry of the silicon-containing molten aluminum alloy after the silicon-containing molten aluminum alloy is introduced into the casting mold.

17. The method for casting an article of claim 14 further comprising:

locating the chamber near the at least one gate.

18. The method for casting an article of claim 14 further comprising:

locating the chamber near the sprue.

19. The method for casting an article of claim 14 wherein the filters comprise a silicon carbide coated ceramic.

20. A method for casting an article comprising:

providing a casting mold comprising:

a plurality of mold cavities;

a sprue;

a runner system comprising a plurality of channels, at least one channel serving each of the plurality of mold cavities;

at least one gate; and at least one chamber located within the plurality of channels;

disposing at least two silicon carbide coated ceramic filters in each of the at least one chamber;

disposing a metallurgical modifier comprising about 3% to about 15% of a strontium-containing alloy in the form of a stock material over the at least two silicon carbide coated ceramic filters in each of the at least one chamber;

disposing an additional metallurgical modifier between the at least two silicon carbide coated ceramic filters in each of the at least one chamber, wherein the additional metallurgical modifier is selected from the group consisting of, antimony, beryllium, boron, calcium, fluxing salts, phosphorus, silver, sodium, titanium, titanium boron, vanadium and zirconium, or a combination thereof;

introducing a silicon-containing molten aluminum alloy into the casting mold over the metallurgical modifiers within the at least one chamber;

adjusting the chemistry of silicon-containing molten aluminum alloy after the silicon-containing molten aluminum alloy is introduced into the casting mold;

modulating flow of the silicon-containing molten aluminum alloy through the chamber with the metallurgical modifier and the silicon carbide coated ceramic filters; and forming a silicon-aluminum metal melt cast.

* * * * *